US008773478B2

(12) United States Patent
Kim et al.

(10) Patent No.: US 8,773,478 B2
(45) Date of Patent: Jul. 8, 2014

(54) ORGANIC LIGHT EMITTING DISPLAY AND DRIVING METHOD THEREOF

(75) Inventors: Min-Cheol Kim, Yongin (KR); In-Hwan Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 345 days.

(21) Appl. No.: 13/238,432

(22) Filed: Sep. 21, 2011

(65) Prior Publication Data

US 2012/0249604 A1 Oct. 4, 2012

(30) Foreign Application Priority Data

Apr. 1, 2011 (KR) ..... 10-2011-0030245

(51) Int. Cl.
*G09G 5/00* (2006.01)

(52) U.S. Cl.
USPC ..... 345/690; 345/204; 345/77; 345/63

(58) Field of Classification Search
USPC ..... 345/690, 204, 77, 63
See application file for complete search history.

(56) References Cited

U.S. PATENT DOCUMENTS

| | | | | |
|---|---|---|---|---|
| 7,391,401 | B2 * | 6/2008 | Kim et al. | 345/96 |
| 2005/0116656 | A1 * | 6/2005 | Shin | 315/169.3 |
| 2006/0114199 | A1 * | 6/2006 | Kim | 345/77 |
| 2008/0239180 | A1 * | 10/2008 | Sekine | 349/37 |
| 2010/0134451 | A1 * | 6/2010 | Cho et al. | 345/205 |

* cited by examiner

*Primary Examiner* — Lixi C Simpson
(74) *Attorney, Agent, or Firm* — Christie, Parker & Hale, LLP

(57) ABSTRACT

An organic light emitting display includes a first display unit having pixels coupled to odd scan and data lines, a second display unit having pixels coupled to even scan and data lines, a third display unit having pixels coupled to the odd scan lines and even data lines, and a fourth display unit having pixels coupled to the even scan lines and odd data lines. A timing controller extracts image data corresponding to each of the display units from inputted image data of one frame. A scan driver sequentially supplies a scan signal to the scan lines in each of four sub-frame periods of one frame period. A data driver converts extracted image data of each of the display units into corresponding data voltages, and supplies the corresponding data voltages to respective ones of the display units through the data lines for respective sub-frame periods of the one frame period.

14 Claims, 6 Drawing Sheets

ORGANIC LIGHT EMITTING DISPLAY AND DRIVING METHOD THEREOF

CROSS-REFERENCE TO RELATED APPLICATIONS

This application claims priority to and the benefit of Korean Patent Application No. 10-2011-0030245, filed on Apr. 1, 2011, in the Korean Intellectual Property Office, the entire content of which is incorporated herein by reference.

BACKGROUND

1. Field

Aspects of embodiments of the present invention are directed toward an organic light emitting display and a driving method thereof.

2. Description of the Related Art

Recently, there have been developed various types of flat panel display devices with reduced weight and volume compared to that of cathode ray tube devices. The flat panel display devices include a liquid crystal display (LCD), a field emission display (FED), a plasma display panel (PDP), an organic light emitting diode (OLED) display device (organic light emitting display), and the like.

Among these flat panel display devices, the OLED display device displays images using OLEDs that emit light through recombination of electrons and holes. The OLED display device has a fast response speed and is driven with low power consumption.

Generally, OLED display devices are classified into a passive matrix OLED (PMOLED) display device and an active matrix OLED (AMOLED) display device, depending on a method of driving organic light emitting elements. The AMOLED display device may include a plurality of gate lines, a plurality of data lines, a plurality of power lines, and a plurality of pixels connected to these lines and arranged in a matrix form. Each of the pixels may include an organic light emitting element; two transistors, i.e., a switching transistor for transmitting a data signal and a driving transistor for driving the organic light emitting element in response to the data signal; and a capacitor for maintaining the voltage of the data signal.

Some suggestions for removing a motion blur phenomenon generated in such an OLED display device include (1) repeatedly displaying the same frame on a screen during a time corresponding to one frame of input data (by increasing a frame rate) or (2) inserting black data in the middle of the frame. However, the method of repeatedly displaying the same frame does not have a substantial effect in the improvement of motion blur, and causes an increase in power consumption. Further, the method of inserting the black data results in screen flickering.

SUMMARY

Aspects of embodiments of the present invention provide for an organic light emitting display and a driving method thereof, in which an image of one frame is divided into images, and the divided images are displayed in four display units, respectively, so that it is possible to remove the motion blur phenomenon without an increase in power consumption. Further, aspects of embodiments of the present invention also provide for an organic light emitting display and a driving method thereof, which can display an image inputted at a specific frame rate as an image displayed at a four times faster frame rate.

In an exemplary embodiment according to the present invention, an organic light emitting display is provided. The organic light emitting display includes a first display unit, a second display unit, a third display unit, a fourth display unit, a timing controller, a scan driver, and a data driver. The first display unit includes first pixels coupled to odd scan lines and odd data lines. The second display unit includes second pixels coupled to even scan lines and even data lines. The third display unit includes third pixels coupled to the odd scan lines and the even data lines. The fourth display unit includes fourth pixels coupled to the even scan lines and the odd scan lines. The timing controller is for extracting image data corresponding to each of the display units from inputted image data of one frame. The scan driver is for sequentially supplying a scan signal to the scan lines in each of four sub-frame periods during one frame period. The data driver is for converting the extracted image data of each of the display units into corresponding data voltages, and for supplying the corresponding data voltages to respective ones of the display units through the data lines for respective sub-frame periods of the one frame period.

The data driver may be configured to supply a black voltage to pixels not included in the respective ones of the display units for the respective sub-frame periods of the one frame period.

The data driver may include a data processor, an output unit, or a black unit. The data processor is for converting the extracted image data of each of the display units into the corresponding data voltages, and for outputting the corresponding data voltages. The output unit includes a plurality of output buffers for applying respective ones of the outputted data voltages to respective first ones of the data lines in accordance with a load signal being applied to the output unit. The black unit includes a plurality of black buffers for applying the black voltage to respective second ones of the data lines in accordance with a black signal being applied to the black unit.

The black voltage may be a high-level voltage of the scan signal.

Each of the pixels may include a driving transistor including a PMOS transistor.

The data processor may include a shift register for outputting a latch control signal corresponding to a clock signal and a synchronization signal; a data latch for sequentially receiving the extracted image data in response to the latch control signal, and for outputting the extracted image data in parallel; and a D/A converter for converting the extracted image data outputted from the data latch into the data voltages, and for outputting the data voltages.

Each of the pixels may be configured to not emit light when supplied with the black voltage.

The data driver may include a data processor for converting the respective extracted image data of each of the display units into the corresponding data voltages, and for outputting the corresponding data voltages.

The data processor may include a shift register for outputting a latch control signal corresponding to a clock signal and a synchronization signal; a data latch for sequentially receiving the extracted image data in response to the latch control signal, and for outputting the extracted image data in parallel; and a D/A converter for converting the extracted image data outputted from the data latch into the data voltages, and for outputting the data voltages.

In another exemplary embodiment of the present invention, a driving method of an organic light emitting display is provided. The organic light emitting display includes a first display unit including first pixels coupled to odd scan lines and odd data lines, a second display unit including second pixels coupled to even scan lines and even data lines, a third display unit including third pixels coupled to the odd scan lines and the even data lines, and a fourth display unit including fourth pixels coupled to the even scan lines and the odd scan lines. The method includes (a) sequentially supplying a scan signal to the scan lines for each of four sub-frame periods during one frame period; (b) converting image data of each of the display units into corresponding data voltages; and (c) supplying the corresponding data voltages to respective ones of the display units through the data lines for respective sub-frame periods of the one frame period.

Step (c) may include supplying a black voltage to pixels not included in the respective ones of the display units for the respective sub-frame periods of the one frame period.

The black voltage may be a high-level voltage of the scan signal.

Each of the pixels may include a driving transistor including a PMOS transistor.

Each of the pixels may be configured to not emit light when supplied with the black voltage.

As described above, according to aspects of embodiments of the present invention, it is possible to provide an organic light emitting display and a driving method thereof, in which an image of one frame is divided into images, and the divided images are displayed in four display units, respectively, so that it is possible to remove the motion blur phenomenon without an increase in power consumption. In addition, it is possible to provide an organic light emitting display and a driving method thereof, which can display an image inputted at a specific frame rate as an image displayed at a four times faster frame rate.

BRIEF DESCRIPTION OF THE DRAWINGS

The accompanying drawings, together with the specification, illustrate exemplary embodiments of the present invention, and, together with the description, serve to explain the principles of the present invention.

FIG. 6, which includes

DETAILED DESCRIPTION

Figure 1:
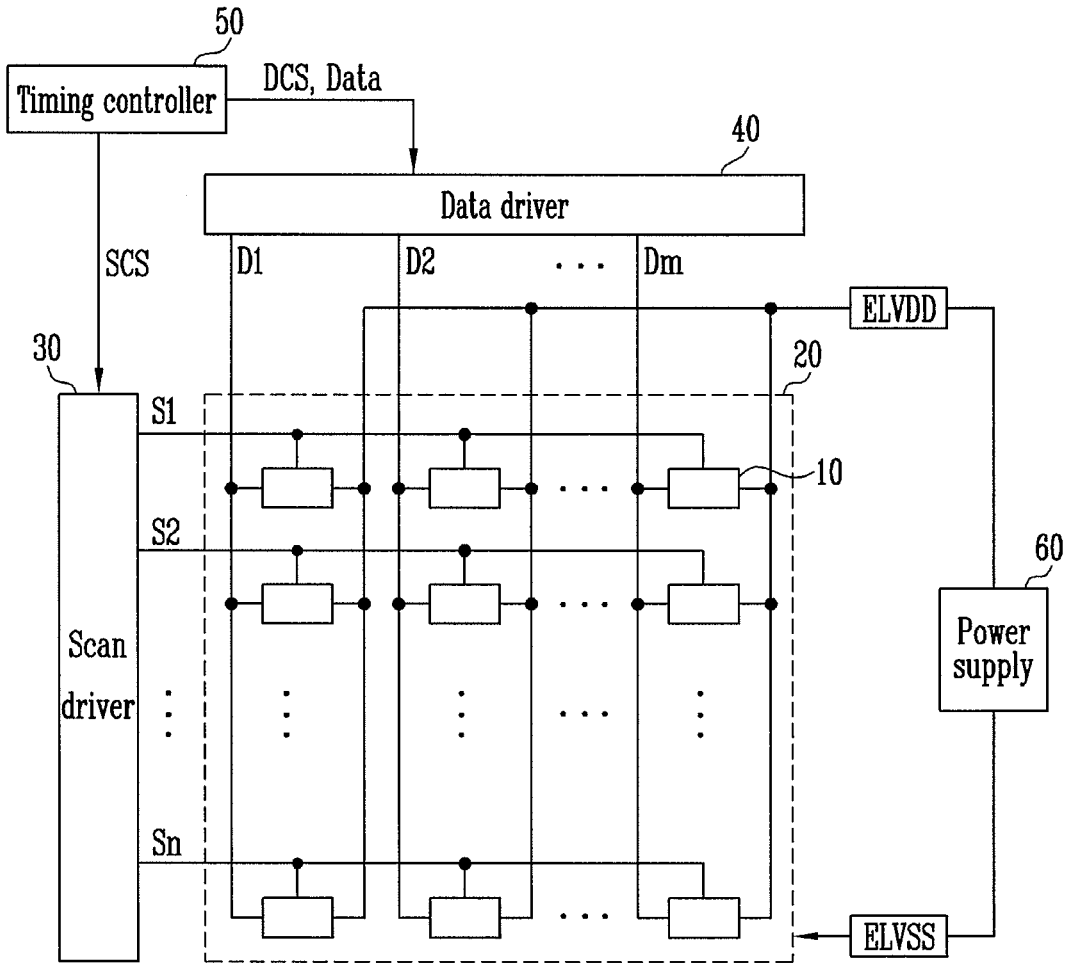
FIG. 1 is a block diagram of an organic light emitting display according to an embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via one or more third elements. Further, some of the elements that are not essential to the complete understanding of the invention are omitted for clarity. Finally, like reference numerals refer to like elements throughout.

FIG. 1 is a block diagram of an organic light emitting display according to an embodiment of the present invention.

Referring to FIG. 1, the organic light emitting display includes a display unit 20 having a plurality of pixels 10 coupled to scan lines S1 to Sn and data lines D1 to Dm, a scan driver 30 for supplying a scan signal to each of the pixels 10 through the scan lines S1 to Sn, a data driver 40 for supplying a data voltage to each of the pixels 10 through the data lines D1 to Dm, and a timing controller 50 for controlling the scan driver 30 and the data driver 40.

The display unit 20 is divided into four partial display units. The four partial display units are referred to as a first display unit, a second display unit, a third display unit and a fourth display unit, respectively.

The first display unit includes pixels coupled to odd scan lines (for example, odd-numbered scan lines S1, S3, . . . , Sn−1) and odd data lines (for example, odd-numbered data lines D1, D3, . . . , Dm−1). For ease of description, n and m can be assumed to be even numbers, though the invention is not limited thereto.

In a similar fashion, the second display unit includes pixels coupled to even scan lines (for example, even-numbered scan lines S2, S4, Sn) and even data lines (for example, even-numbered data lines D2, D4, . . . , Dm). In addition, the third display unit includes pixels coupled to odd-numbered scan lines S1, S3, . . . , Sn−1 and even-numbered data lines D2, D4, . . . , Dm. Finally, the fourth display unit includes pixels coupled to even-numbered scan lines S2, S4, Sn and odd-numbered data lines D1, D3, . . . , Dm−1. Accordingly, each of the pixels belongs to one of the first, second, third, or fourth display units.

Figure 2:
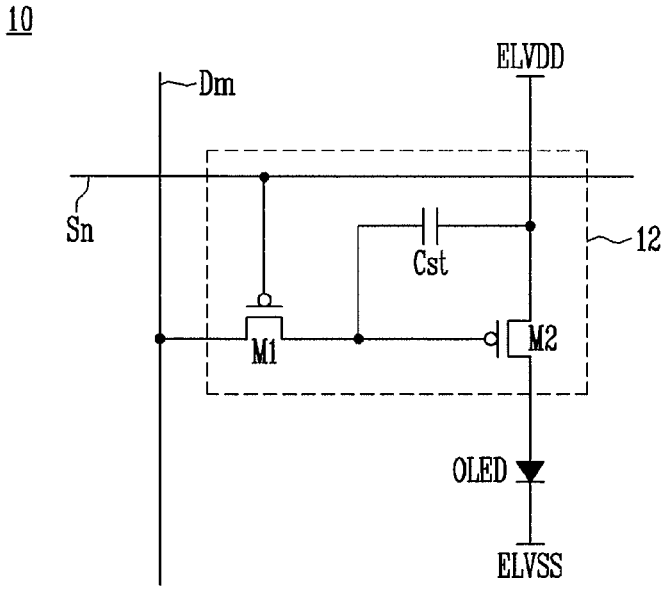
FIG. 2 is a circuit diagram of a pixel according to an embodiment of the present invention.

FIG. 2 is a circuit diagram of a pixel 10 according to an embodiment of the present invention. For convenience of illustration, the pixel 10 coupled to an n-th scan line Sn and an m-th data line Dm is shown in FIG. 2.

Each of the pixels 10 is coupled to a first power source ELVDD and a second power source ELVSS to generate light corresponding to the data voltage. In this instance, the first power source ELVDD may be a high-potential power source, and the second power source ELVSS may be a low-potential power source (e.g., a ground power source) having a lower voltage than that of the first power source ELVDD.

In the organic light emitting display of FIG. 1, the first power source ELVDD and the second power source ELVSS are supplied from a power supply 60. To this end, the power supply 60 converts a power source inputted from the outside thereof and generates the first power source ELVDD and the second power source ELVSS.

Referring back to FIG. 2, each of the pixels 10 in the organic light emitting display is provided with an organic light emitting diode (OLED) and a pixel circuit 12 coupled to a data line Dm and a scan line Sn to control the OLED. An anode electrode of the OLED is coupled to the pixel circuit 12, and a cathode electrode of the OLED is coupled to the second power source ELVSS. The OLED generates light of a luminance (for example, a predetermined luminance) corresponding to a current supplied from the pixel circuit 12.

When a scan signal is supplied to the scan line Sn, the pixel circuit 12 controls the amount of current supplied to the OLED to correspond to a data voltage supplied to the data line Dm. To this end, the pixel circuit 12 is provided with a second transistor M2 coupled between the first power source ELVDD and the OLED, a first transistor M1 coupled among the second transistor M2, the data line Dm, and the scan line Sn, and a storage capacitor Cst coupled between gate and first electrodes of the second transistor M2.

Thus, the first transistor M1 becomes a switching transistor and is turned on by the scan signal to transfer the data voltage to a driving transistor. Further, the second transistor M2 becomes the driving transistor and receives the data voltage supplied from the switching transistor to generate a current corresponding to the data voltage. The second transistor M2 supplies the generated current to the OLED.

A gate electrode of the first transistor M1 is coupled to the scan line Sn, and a first electrode of the first transistor M1 is coupled to the data line Dm. A second electrode of the first transistor M1 is coupled to one terminal of the storage capacitor Cst. Here, the first electrode is set to one of source and drain electrodes, and the second electrode is set to the other of the source and drain electrodes. For example, if the first electrode is set to the source electrode, the second electrode is set to the drain electrode. When the scan signal is supplied from the scan line Sn, the first transistor M1 (that is coupled to the scan line Sn and the data line Dm) is turned on to supply the data voltage supplied from the data line Dm to the storage capacitor Cst. In this instance, the data voltage is charged in the storage capacitor Cst.

The gate electrode of the second transistor M2 is coupled to the one terminal of the storage capacitor Cst, and the first electrode of the second transistor M2 is coupled to the other terminal of the storage capacitor Cst and the first power source ELVDD. A second electrode of the second transistor M2 is coupled to the anode electrode of the OLED. The second transistor M2 controls the amount of current that flows from the first power source ELVDD to the second power source ELVSS via the OLED to correspond to the voltage stored in the storage capacitor Cst. In this instance, the OLED generates light corresponding to the amount of current supplied from the second transistor M2.

The aforementioned pixel structure of FIG. 2 is merely one embodiment of the present invention, and the pixel 10 of the present invention is not limited to the pixel structure of FIG. 2.

Referring back to FIG. 1, the scan driver 30 generates the scan signal in response to a scan driver control signal SCS supplied from the timing controller 50, and sequentially supplies the generated scan signal to the scan lines S1 to Sn. The scan driver 30 performs a sub-frame period (SF) four times during one frame period in which an image of one frame is displayed. In the sub-frame period, the scan signal is sequentially supplied to all the scan lines S1 to Sn. That is, the four sub-frame periods are performed, so that the four display units sequentially emit light. Accordingly, the image of the frame is displayed.

The data driver 40 supplies a data voltage to each of the pixels 10 for each row (in synchronization with the scan signal supplied by the scan driver 30) in response to a data driver control signal DCS supplied from the timing controller 50. More particularly, the data driver 40 supplies corresponding data voltages so that different display units emit light for the respective sub-frame periods performed by the scan driver 30.

To this end, the data driver 40 receives image data Data corresponding to a specific display unit extracted from image data of one frame, supplied by the timing controller 50, and converts the image data Data into the corresponding data voltages according to the gray level of each of the image data Data. Then, the data driver 40 supplies the corresponding data voltages to the data lines D1 to Dm in synchronization with the scan signal supplied in each of the sub-frame periods.

Accordingly, an image inputted at a specific frame rate can be displayed as an image at a four times faster frame rate. For example, an image supplied at a frame rate of 240 Hz can be displayed as an image at a frame rate of 960 Hz.

The data driver 40 may display black by supplying a black voltage Vblack to pixels not included in the display unit that receives the corresponding data voltages supplied for each of the sub-frame periods. That is, the three-fourths of the pixels that are not part of the current display unit may display black while the other one-fourth of the pixels (that is, the pixels that are part of the current display unit) display an image corresponding to the image data Data. The black voltage Vblack may be supplied from the power supply 60 that generates the first power source ELVDD and the second power source ELVSS.

The timing controller 50 extracts the image data Data corresponding to the respective first to fourth display units from image data of one frame, inputted from the outside, and supplies the extracted image data to the data driver 40. The timing controller 50 controls the scan driver 30 by supplying the scan driver control signal SCS to the scan driver, and controls the data driver 40 by supplying the data driver control signal DCS to the data driver 40. The timing controller 50 may include a frame memory that stores the image data of one frame, inputted from the outside, and the image data Data of each of the display units, extracted from the image data of the one frame.

Figure 3:
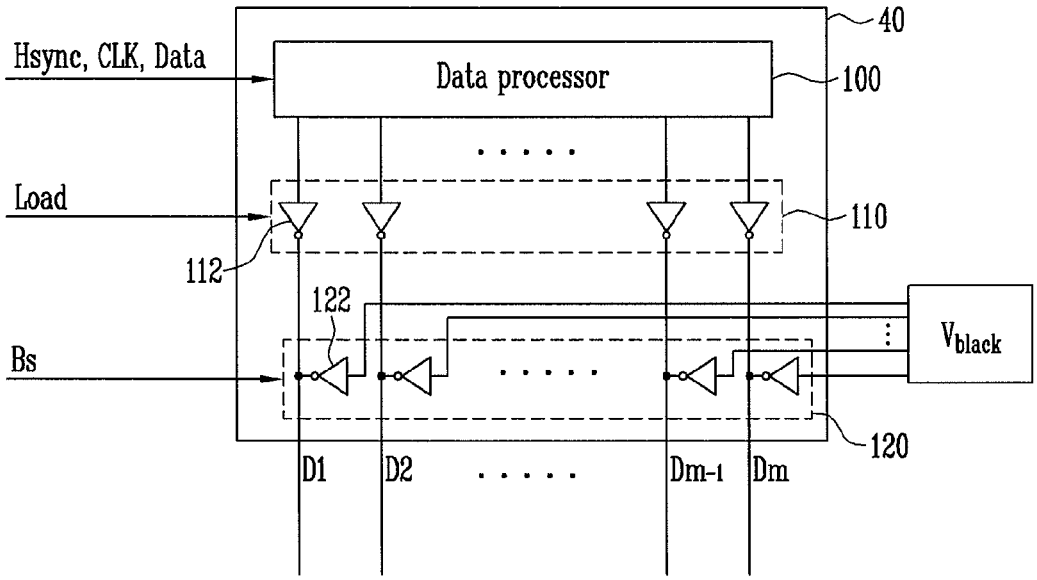
FIG. 3 is a block diagram showing a data driver according to an embodiment of the present invention.

FIG. 3 is a block diagram showing the data driver 40 according to an embodiment of the present invention.

Referring to FIG. 3, the data driver 40 includes a data processor 100, an output unit 110, and a black unit 120. The data processor 100 receives a horizontal synchronization signal Hsync and a clock signal CLK, and converts the image data Data of each of the display units, inputted from the timing controller 50, into corresponding data voltages. Then, the data processor 100 outputs, in parallel, the data voltages to the data lines D1 to Dm. The horizontal synchronization signal Hsync and the clock signal CLK are included in the data driver control signal DCS.

The output unit 110 includes a plurality of output buffers 112 respectively coupled to output terminals of the data processor 100. A load signal Load is used to select which of the output buffers 112 (for example, odd output buffers coupled to the odd data lines, even output buffers coupled to the even data lines) transfer the corresponding data voltages to the data lines. When the load signal Load is supplied to the output unit 110, each of the output buffers 112 in the corresponding plurality of output buffers 112 selected by the load signal Load (for example, odd output buffers or even output buffers) applies one of the data voltages to a corresponding data line.

For example, when the load signal Load that selects the odd output buffers is supplied to the output unit 110, each of the odd output buffers transfers one of the data voltages to the corresponding odd data line, while each of the even output buffers is in a high-impedance state and so does not transfer a data voltage to the corresponding even data line. However, when the load signal Load is not supplied to the output unit 110, each of the output buffers 112 is in the high-impedance state and so does not transfer a data voltage to the corresponding data line.

In a similar fashion, the black unit 120 includes a plurality of black buffers 122 respectively coupled to output terminals of the plurality of output buffers 112. A black signal Bs is used to select which of the black buffers 122 (for example, odd black buffers coupled to the odd data lines, even black buffers coupled to the even data lines, or all the black buffers) transfer the black voltage to the corresponding data lines. When the black signal Bs is supplied to the black unit 120, each of the black buffers 122 in the corresponding plurality of black buffers 122 selected by the black signal Bs (for example, odd black buffers, even black buffers, or all black buffers 122) applies the black voltage Vblack to a corresponding data line.

For example, when the black signal Bs that selects all of the black buffers 122 is supplied to the black unit 120, each of the black buffers 122 transfers the black voltage Vblack to the corresponding data line. For another example, when the black signal Bs that selects the even black buffers is supplied to the black unit 120, each of the even black buffers transfers the black voltage Vblack to the corresponding even data line, while each of the odd black buffers is in a high-impedance state and so does not transfer the black voltage Vblack to the corresponding odd data line. However, when the black signal Bs is not supplied to the black display unit 120, each of the black buffers 122 is in the high-impedance state and so does not transfer the black voltage Vblack to the corresponding data line.

That is, in order to apply one of the data voltages outputted from the data processor 100 to the corresponding data line, a load signal Load that selects the output buffer 112 coupled to the corresponding data line is supplied to the output unit 110. In addition, the black buffer 122 coupled to the corresponding data line is set to be in the high-impedance state (for example, by not supplying a black signal Bs, or by supplying a black signal Bs that does not select the black buffer 122).

Further, in order to apply the black voltage to the corresponding data line, the output buffer 112 coupled to the corresponding data line is set to be in the high-impedance state (for example, by not supplying a load signal Load, or by supplying a load signal Load that does not select the output buffer 112). In addition, a black signal Bs that selects the black buffer 122 coupled to the corresponding data line is supplied to the black unit 120.

Thus, the data voltages can be applied to desired pixels through the output unit 110, and black can be displayed by applying the black voltage Vblack to the other pixels through the black unit 120. When the plurality of pixels 10 included in the display unit 20 receive the black voltage Vblack supplied from the black unit 120, they do not emit light and thus display black.

Each of the output buffers 112 and the black buffers 122 may be tri-state buffers controlled by the load signal Load and the black signal Bs, respectively. The load signal Load and the black signal Bs are included in the data driver control signal DCS.

In the above-described embodiment, the black voltage Vblack may be a high-level voltage VGH of the scan signal supplied to each of the pixels 10. In this instance, the high-level voltage VGH may be supplied from the power supply 60, or may be supplied from the scan driver 30.

Therefore, in each of the pixels 10, the driving transistor may be a PMOS transistor so that when the high-level voltage VGH is supplied to the pixel 10, the pixel 10 does not emit light and instead displays black. The switching transistor may also be a PMOS transistor to be turned on by the scan signal having the high-level voltage VGH. Each of the pixels 10 may thus be configured using only PMOS transistors. Accordingly, it is possible to display black using the high-level voltage VGH of the scan signal without generating a separate black voltage Vblack.

Figure 4:
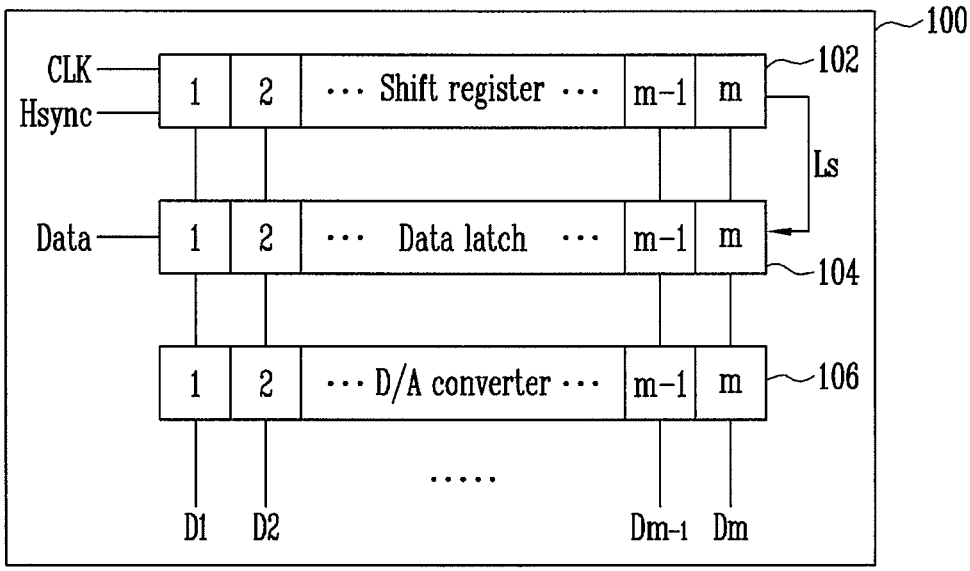
FIG. 4 is a view showing a data processor according to an embodiment of the present invention.

FIG. 4 is a view showing the data processor 100 according to an embodiment of the present invention.

Referring to FIG. 4, the data processor 100 according to this embodiment includes a shift register 102, a data latch 104, and a digital-to-analog (D/A) converter 106. The shift register 102 performs a function of controlling the data latch 104 by receiving a horizontal synchronization signal Hsync and a clock signal CLK and outputting a latch control signal Ls.

The data latch 104 sequentially receives image data Data of each of the display units and outputs, in parallel (by scan line, for each of the data lines), the image data Data to the D/A converter 106. The data latch 104 is controlled by the latch control signal Ls outputted from the shift register 102.

The data latch 104 may include a sampling latch and a holding latch. The switching latch sequentially receives the image data Data in response to the latch control signal Ls outputted from the shift register 102 and outputs, in parallel, the image data Data to the holding latch. The holding latch receives the image data Data outputted in parallel from the sampling latch and maintains the image data Data for a certain period of time.

The D/A converter 106 converts the image data Data outputted from the data latch 104 into corresponding data voltages. The data voltages are analog gray-level voltages. The D/A converter 106 outputs the data voltages through its output terminals.

Figure 5:
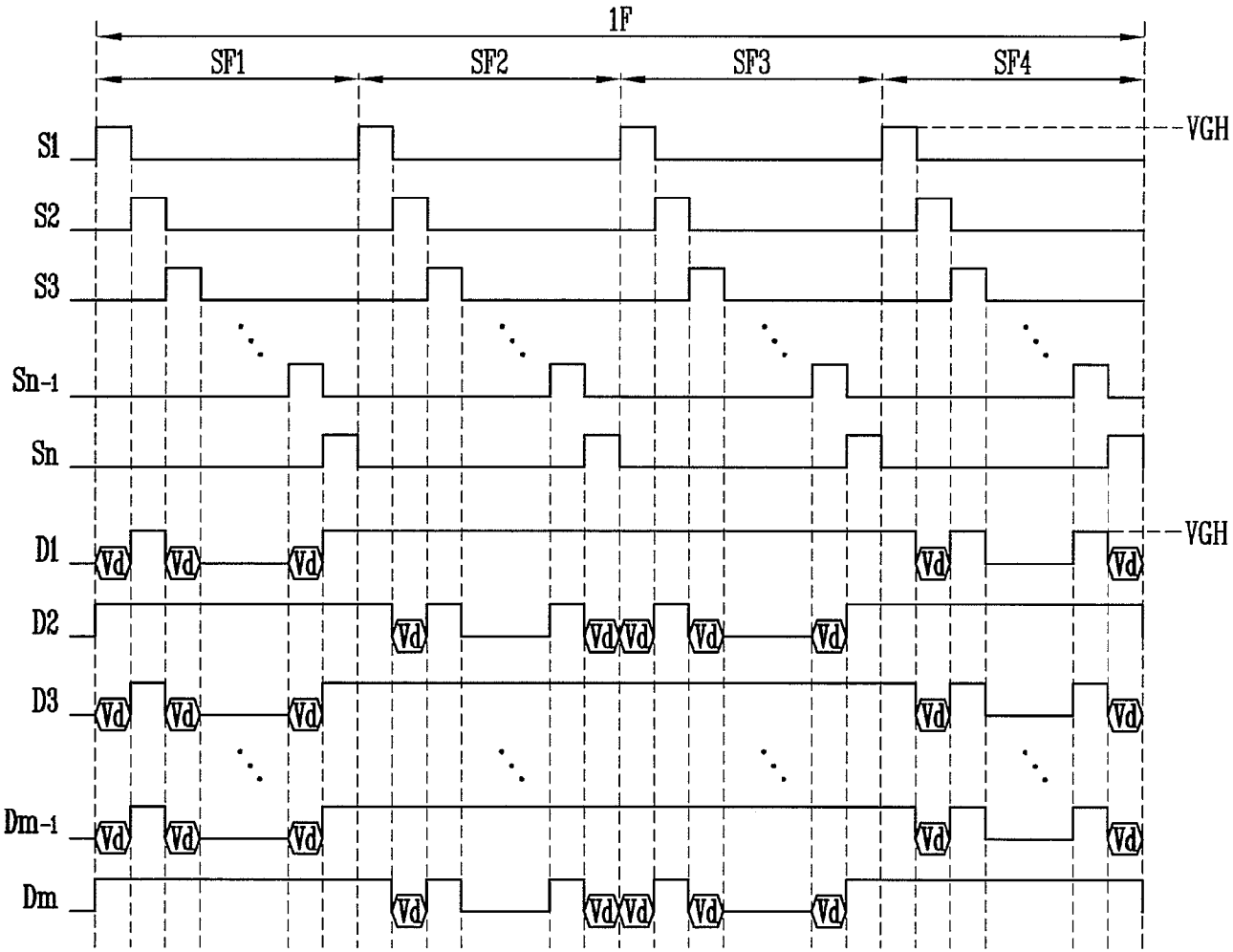
FIG. 5 is a waveform diagram illustrating a driving method of an organic light emitting display according to an embodiment of the present invention.

FIG. 5 is a waveform diagram illustrating a driving method of an organic light emitting display according to an embodiment of the present invention. FIG. 6, which includes FIGS. 6A-6D, is a series of views showing a display unit of the organic light emitting display of FIG. 1, driven according to the waveform diagram of FIG. 5.

More particularly, FIGS. 5 and 6 illustrate an example in which first, second, third and fourth display units (as defined above, and corresponding to FIGS. 6A, 6B, 6C, and 6D, respectively) sequentially emit light. In FIG. 6, a white portion indicates a pixel that emits light during the respective sub-frame, and a black portion indicates a pixel subjected to black display (non-emission). In FIGS. 5 and 6, m and n are set as even numbers. The driving method of the organic light emitting display according to this embodiment will be described with reference to FIGS. 5 and 6.

In order to divide an image of one frame, inputted from the timing controller 50, into images and display the divided images in four display units, image data Data corresponding to each of the display units is first extracted from the image data of the one frame, and the extracted image data Data of each of the display units is supplied to the data driver 40. Accordingly, the data driver 40 allows one display unit to emit light for each of sub-frame periods SF1, SF2, SF3, and SF4 that constitute one frame period 1 F.

To this end, the data driver 40 receives the image data Data of each of the display units, supplied from the timing controller 50, and converts the image data Data into corresponding data voltages for each of the display units. Then, the data driver 40 supplies the data voltages to each of the display units.

Next, a scan signal is sequentially supplied to all the scan lines S1 to Sn for the first sub-frame period SF1. In this instance, corresponding data voltages Vd are only supplied to the first display unit composed of pixels coupled to the odd-numbered scan lines and the odd-numbered data lines. Therefore, the data voltages Vd are only applied to the odd-numbered data lines in synchronization with the scan signal being supplied to the odd-numbered scan lines.

That is, when the scan signal is supplied to the odd-numbered scan lines S1, S3, . . . , Sn−1, the corresponding data voltages Vd are supplied to the odd-numbered data lines D1, D3, . . . , Dm−1. In addition, a voltage corresponding to a black display (for example, the black voltage Vblack, or the high-level voltage VGH of the scan signal) is applied to the even-numbered data lines D2, D4, . . . , Dm.

Figure 6A:
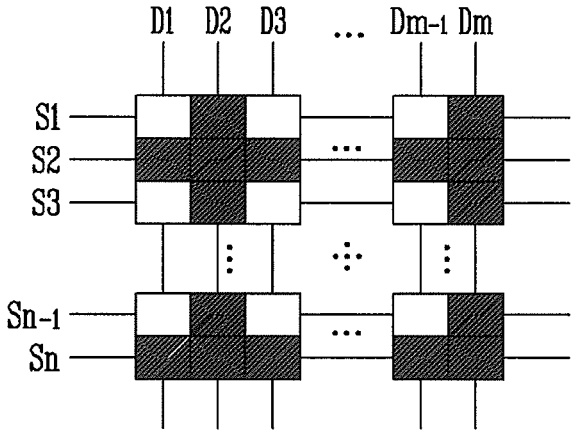
FIGS. 6A-6D, is a series of views of the display unit of the organic light emitting display of FIG. 1, driven according to the waveform diagram of FIG. 5.

If In a similar fashion, when the scan signal is supplied to the even-numbered scan lines S2, S4, . . . , Sn, the black voltage Vblack or the high-level voltage VGH is applied to all the data lines D1 to Dm. Thus, as shown in FIG. 6A, only the first display unit among all the display units emits light for the first sub-frame period SF1.

Subsequently, the scan signal is sequentially supplied to all the scan lines S1 to Sn for the second sub-frame period SF2. In this instance, the corresponding data voltages Vd are only supplied to the second display unit composed of pixels coupled to the even-numbered scan lines and the even-numbered data lines. Therefore, the data voltages Vd are only applied to the even-numbered data lines in synchronization with the scan signal being supplied to the even-numbered scan lines.

Figure 6B:
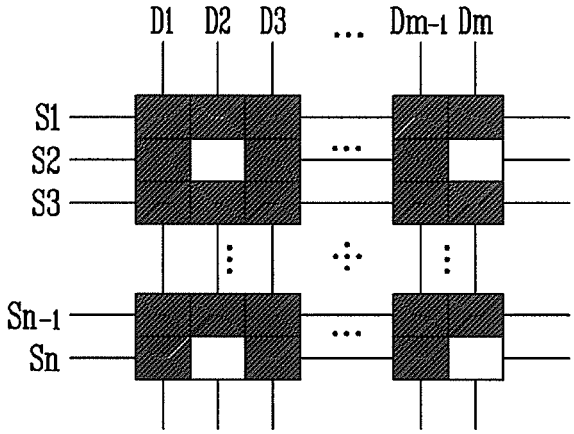

That is, when the scan signal is supplied to the odd-numbered scan lines S1, S3, . . . , Sn−1, the black voltage Vblack or the high-level voltage VGH is supplied to all the data lines D1 to Dm. Further, when the scan signal is supplied to the even-numbered scan lines S2, S4, Sn, the corresponding data voltages Vd are supplied to the even-numbered data lines D2, D4, . . . , Dm. In addition, the black voltage Vblack or the high-level voltage VGH is supplied to the odd-numbered data lines D1, D3, . . . , Dm−1. Thus, as shown in FIG. 6B, only the second display unit among all the display units emits light for the second sub-frame period SF2.

Subsequently, the scan signal is sequentially supplied to all the scan lines S1 to Sn for the third sub-frame period SF3. In this instance, the corresponding data voltages Vd are only supplied to the third display unit composed of pixels coupled to the odd-numbered scan lines and the even-numbered data lines. Therefore, the data voltages Vd are only applied to the even-numbered data lines in synchronization with the scan signal being supplied to the odd-numbered scan lines.

Figure 6C:
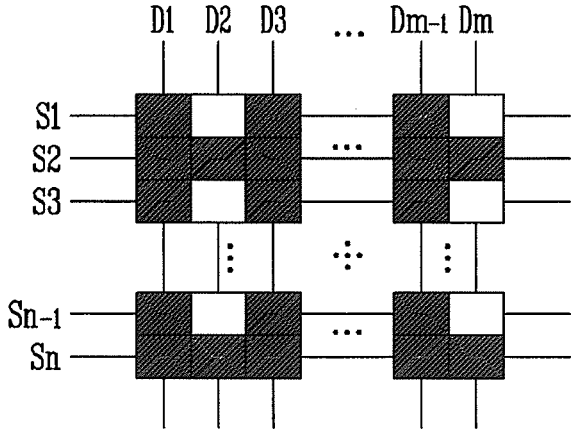

That is, when the scan signal is supplied to the odd-numbered scan lines S1, S3, . . . , Sn−1, the black voltage Vblack or the high-level voltage VGH is supplied to the odd-numbered data lines D1, D3, . . . , Dm−1. In addition, the corresponding data voltages Vd are supplied to the even-numbered data lines D2, D4, . . . , Dm. Further, when the scan signal is supplied to the even-numbered scan lines S2, S4, . . . , Sn, the black voltage Vblack or the high-level voltage VGH is applied to all the data lines D1 to Dm. Thus, as shown in FIG. 6C, only the third display unit among all the display units emits light for the third sub-frame period SF3.

Subsequently, the scan signal is sequentially supplied to all the scan lines S1 to Sn for the fourth sub-frame period SF4. In this instance, the corresponding data voltages Vd are only supplied to the fourth display unit composed of pixels coupled to the even-numbered scan lines and the odd-numbered data lines. Therefore, the data voltages Vd are only applied to the odd-numbered data lines in synchronization with the scan signal being supplied to the even-numbered scan lines.

Figure 6D:
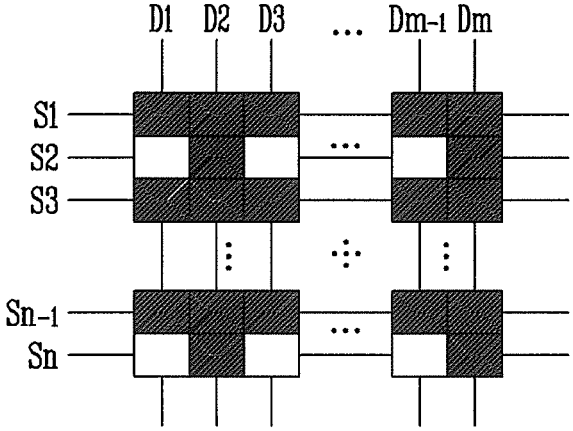

That is, when the scan signal is supplied to the odd-numbered scan lines S1, S3, . . . , Sn−1, the black voltage Vblack or the high-level voltage VGH is applied to all the data lines D1 to Dm. Further, when the scan signal is supplied to the even-numbered scan lines S2, S4, . . . , Sn, the corresponding data voltages Vd are supplied to the odd-numbered data lines D1, D3, . . . , Dm−1. In addition, the black voltage Vblack or the high-level voltage VGH of the scan signal is applied to the even-numbered data lines D2, D4, . . . , Dm. Thus, as shown in FIG. 6D, only the fourth display unit among all the display units emits light for the fourth sub-frame period SF4.

Although it has been described in the aforementioned embodiment that the first, second, third and fourth display units sequentially emit light, the order of the display units that emit light may be changed in other embodiments.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display comprising:

a first display unit comprising first pixels coupled to odd scan lines and odd data lines;

a second display unit comprising second pixels coupled to even scan lines and even data lines;

a third display unit comprising third pixels coupled to the odd scan lines and the even data lines;

a fourth display unit comprising fourth pixels coupled to the even scan lines and the odd scan lines;

a timing controller for extracting image data corresponding to each of the display units from inputted image data of one frame, the one frame comprising a first sub-frame period for supplying the extracted image data of the first display unit, a second sub-frame period for supplying the extracted image data of the second display unit, a third sub-frame period for supplying the extracted image data of the third display unit, and a fourth sub-frame period for supplying the extracted image data of the fourth display unit;

a scan driver for sequentially supplying a scan signal to the scan lines in each of the four sub-frame periods during the one frame; and a data driver for converting the extracted image data of each of the display units into corresponding data voltages, and for supplying the corresponding data voltages to respective ones of the display units through the data lines for respective ones of the sub-frame periods of the one frame.

2. The organic light emitting display according to claim 1, wherein the data driver is configured to supply a black voltage to pixels not included in the respective ones of the display units for the respective ones of the sub-frame periods of the one frame.

3. The organic light emitting display according to claim 2, wherein the data driver comprises:

a data processor for converting the extracted image data of each of the display units into the corresponding data voltages, and for outputting the corresponding data voltages;

an output unit comprising a plurality of output buffers for applying respective ones of the outputted data voltages to respective first ones of the data lines in accordance with a load signal being applied to the output unit; and a black unit comprising a plurality of black buffers for applying the black voltage to respective second ones of the data lines in accordance with a black signal being applied to the black unit.

4. The organic light emitting display according to claim 3, wherein the black voltage is a high-level voltage of the scan signal.

5. The organic light emitting display according to claim 4, wherein each of the pixels comprises a driving transistor comprising a PMOS transistor.

6. The organic light emitting display according to claim 3, wherein the data processor comprises:

a shift register for outputting a latch control signal corresponding to a clock signal and a synchronization signal;

a data latch for sequentially receiving the extracted image data in response to the latch control signal, and for outputting the extracted image data in parallel; and a D/A converter for converting the extracted image data outputted from the data latch into the data voltages, and for outputting the data voltages.

7. The organic light emitting display according to claim 2, wherein each of the pixels is configured to not emit light when supplied with the black voltage.

8. The organic light emitting display according to claim 1, wherein the data driver comprises a data processor for converting the extracted image data of each of the display units into the corresponding data voltages, and for outputting the corresponding data voltages.

9. The organic light emitting display according to claim 8, wherein the data processor comprises:

a shift register for outputting a latch control signal corresponding to a clock signal and a synchronization signal;

a data latch for sequentially receiving the extracted image data in response to the latch control signal, and for outputting the extracted image data in parallel; and a D/A converter for converting the extracted image data outputted from the data latch into the data voltages, and for outputting the data voltages.

10. A driving method of an organic light emitting display comprising a first display unit comprising first pixels coupled to odd scan lines and odd data lines, a second display unit comprising second pixels coupled to even scan lines and even data lines, a third display unit comprising third pixels coupled to the odd scan lines and the even data lines, and a fourth display unit comprising fourth pixels coupled to the even scan lines and the odd scan lines, the method comprising:

(a) extracting image data corresponding to each of the display units from inputted image data of one frame, the one frame comprising a first sub-frame period for supplying the extracted image data of the first display unit, a second sub-frame period for supplying the extracted image data of the second display unit, a third sub-frame period for supplying the extracted image data of the third display unit, and a fourth sub-frame period for supplying the extracted image data of the fourth display unit;

(b) sequentially supplying a scan signal to the scan lines for each of the four sub-frame periods during the one frame;

(c) converting the extracted image data of each of the display units into corresponding data voltages; and (d) supplying the corresponding data voltages to respective ones of the display units through the data lines for respective ones of the sub-frame periods of the one frame.

11. The method according to claim 10, wherein step (d) comprises supplying a black voltage to pixels not included in the respective ones of the display units for the respective ones of the sub-frame periods of the one frame.

12. The method according to claim 11, wherein the black voltage is a high-level voltage of the scan signal.

13. The method according to claim 12, wherein each of the pixels comprises a driving transistor comprising a PMOS transistor.

14. The method according to claim 11, wherein each of the pixels is configured to not emit light when supplied with the black voltage.

* * * * *